US007788771B2

(12) United States Patent
Vollrath

(10) Patent No.: US 7,788,771 B2
(45) Date of Patent: Sep. 7, 2010

(54) APPARATUS ON A SPINNING ROOM MACHINE, ESPECIALLY A SPINNING PREPARATION MACHINE, FOR DEPOSITING FIBRE SLIVER

(75) Inventor: Ulrich Vollrath, Neuss (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 241 days.

(21) Appl. No.: 12/076,210

(22) Filed: Mar. 14, 2008

(65) Prior Publication Data

US 2008/0244871 A1 Oct. 9, 2008

(30) Foreign Application Priority Data

Apr. 3, 2007 (DE) ..... 10 2007 016 340

(51) Int. Cl.
*D01G 27/00* (2006.01)

(52) U.S. Cl. ..... 19/159 R

(58) Field of Classification Search ..... 19/159 R
See application file for complete search history.

(56) References Cited

U.S. PATENT DOCUMENTS

| | | | |
|---|---|---|---|
| 928,563 | A | 7/1909 | Thoens |
| 1,948,615 | A | 2/1934 | Clark |
| 2,425,301 | A | 8/1947 | Browner |
| 3,060,518 | A | 10/1962 | Hill |
| 3,226,794 | A | 1/1966 | Erb |
| 3,281,913 | A | 11/1966 | Morehead et al. |
| 3,348,783 | A | 10/1967 | Mackie |
| 3,482,795 | A | 12/1969 | Mackie |
| 3,496,862 | A | 2/1970 | Sowerby |
| 3,509,687 | A | 5/1970 | Fleissner |
| 3,541,752 | A | 11/1970 | Ness |
| 3,808,641 | A | 5/1974 | Schneider et al. |
| 4,683,619 | A | 8/1987 | Langen et al. |
| 4,723,344 | A | 2/1988 | Leifeld |
| 4,891,918 | A | 1/1990 | Wiley |

(Continued)

FOREIGN PATENT DOCUMENTS

| | | |
|---|---|---|
| CH | 1 28 869 | 11/1928 |

(Continued)

OTHER PUBLICATIONS

Search Report from Turkish Application No. 2006/04816 dated Jul. 30, 2008.

(Continued)

*Primary Examiner*—Shaun R Hurley
(74) *Attorney, Agent, or Firm*—Venable LLP; Robert Kinberg; Justine A. Gozzi

(57) ABSTRACT

In an apparatus on a spinning room machine for depositing fiber sliver, a stationary delivery device for delivering fiber sliver and a substantially flat receiving support surface for receiving and collecting the fiber sliver as a can-less fiber sliver package are present. The receiving support surface, which is substantially unenclosed, is movable during the depositing process back and forth in the horizontal direction by a drive arrangement. In order to improve the production of the can-less fiber sliver package, the speed of the receiving support surface with the sliver package is alterable substantially on a reversal path such that a gradual braking to speed value zero to the speed of the back and forth movement are effected.

22 Claims, 6 Drawing Sheets

U.S. PATENT DOCUMENTS

| | | | | |
|---|---|---|---|---|
| 4,956,969 | A | 9/1990 | Raasch | |
| 5,081,744 | A | 1/1992 | Siegenthaler et al. | |
| 5,085,377 | A | 2/1992 | Rohrer et al. | |
| 5,125,210 | A | 6/1992 | Lang et al. | |
| 5,200,269 | A | 4/1993 | Lukhard et al. | |
| 5,257,897 | A | 11/1993 | Yamamoto et al. | |
| 5,412,845 | A | 5/1995 | Ueding et al. | |
| 5,446,946 | A | 9/1995 | Leifeld | |
| 5,450,656 | A | 9/1995 | Ueding et al. | |
| 5,491,877 | A | 2/1996 | Leifeld | |
| 5,511,372 | A | 4/1996 | Liedgens | |
| 5,528,797 | A | 6/1996 | Otmar et al. | |
| 5,535,581 | A | 7/1996 | Tahara et al. | |
| 5,560,179 | A | 10/1996 | Leifeld | |
| 5,561,889 | A | 10/1996 | Leifeld | |
| 5,575,040 | A | 11/1996 | Leifeld et al. | |
| 5,581,849 | A | 12/1996 | Kriegler et al. | |
| 5,595,049 | A | 1/1997 | Leifeld | |
| 5,664,398 | A * | 9/1997 | Leifeld | 53/118 |
| 5,787,553 | A | 8/1998 | Liedgens | |
| 5,826,812 | A | 10/1998 | Hand | |
| 5,829,100 | A | 11/1998 | Stentenbach | |
| 5,881,861 | A | 3/1999 | Langen | |
| 6,182,425 | B1 | 2/2001 | Ficker et al. | |
| 6,279,306 | B1 | 8/2001 | Langen | |
| 6,334,237 | B1 | 1/2002 | Tsuzuki | |
| 6,345,417 | B2 | 2/2002 | Lederi | |
| 6,425,163 | B1 | 7/2002 | von Gehlen | |
| 7,410,051 | B2 | 8/2008 | Warlick | |
| 2003/0146331 | A1 | 8/2003 | Schlichter | |
| 2006/0027695 | A1 | 2/2006 | Schlichter | |
| 2006/0065554 | A1 | 3/2006 | Warlick | |
| 2007/0063088 | A1 | 3/2007 | Schlichter | |
| 2007/0063089 | A1 | 3/2007 | Schlichter | |
| 2007/0068397 | A1 | 3/2007 | Schlichter | |
| 2007/0069058 | A1 | 3/2007 | Schlichter | |
| 2007/0069059 | A1 | 3/2007 | Schlichter | |
| 2008/0029637 | A1 | 2/2008 | Schlichter | |
| 2008/0244871 | A1 | 10/2008 | Vollrath | |

FOREIGN PATENT DOCUMENTS

| | | | |
|---|---|---|---|
| CH | 418908 | | 8/1966 |
| CH | 436 199 | | 5/1967 |
| DE | 575 175 | | 4/1933 |
| DE | 1081823 | B | 8/1962 |
| DE | 1145062 | | 3/1963 |
| DE | 1 875 947 | | 7/1963 |
| DE | 3422 140 | A1 | 12/1985 |
| DE | 38 19 854 | A1 | 1/1989 |
| DE | 37 34 425 | C2 | 3/1989 |
| DE | 40 18 088 | | 1/1991 |
| DE | 4217981 | | 12/1993 |
| DE | 43 04 988 | C1 | 4/1994 |
| DE | 4407849 | | 11/1994 |
| DE | 4432634 | | 3/1996 |
| DE | 19611500 | | 1/1997 |
| DE | 19542599 | | 5/1997 |
| DE | 3738190 | | 10/1997 |
| DE | 19850092 | | 5/2000 |
| DE | 102 05 061 | A1 | 8/2003 |
| DE | 10252174 | | 5/2004 |
| EP | 0311394 | | 4/1989 |
| EP | 0 320 467 | | 6/1989 |
| EP | 0457099 | | 4/1994 |
| FR | 650 306 | B | 1/1929 |
| FR | 1 226 668 | | 7/1960 |
| FR | 1 395 509 | | 3/1965 |
| FR | 2021647 | | 7/1970 |
| FR | 2 540 476 | | 10/1984 |
| GB | 298 442 | | 10/1928 |
| GB | 314190 | | 6/1929 |
| GB | 317 029 | | 8/1929 |
| GB | 412893 | | 7/1934 |
| GB | 966294 | | 8/1964 |
| GB | 1 166 650 | | 10/1969 |
| GB | 1397812 | | 6/1975 |
| GB | 1555650 | | 11/1979 |
| GB | 2205544 | | 12/1988 |
| GB | 2277936 | | 11/1994 |
| GB | 2287964 | | 10/1995 |
| GB | 2292392 | | 2/1996 |
| GB | 2385064 | | 8/2003 |
| GB | 2420107 | | 5/2006 |
| JP | 61045868 | | 3/1986 |
| JP | 61047835 | | 3/1986 |
| WO | WO-03/078253 | A1 | 9/2003 |

OTHER PUBLICATIONS

Search Report from British Application No. 0805586.5 dated Jun. 30, 2008.

British Search Report dated Feb. 12, 2007 based on British Application No. GB0620168.5.

British Search Report dated Feb. 20, 2007 based on British Application No. GB0620181.8.

British Search Report dated Feb. 21, 2007 based on British Application No. GB0620179.2.

German Search Report dated Sep. 1, 2006 based on German Application No. 10 2006 012 581.9.

German Search Report dated Sep. 1, 2006 based on German Application No. 10 2006 012 483.9.

German Search Report dated Dec. 18, 2007 based on German Application No. 10 2007 016 340.3 and translation.

Search Report from German Application No. 10 2006 012 579.7 dated Sep. 5, 2006 and translation.

British Search Report dated Feb. 12 , 2007 based on British Application No. GB 0620182.6.

British Search Report dated Feb. 12, 2007 based on British Application No. GB 0620172.7.

Search Report from German Application No. 10 2006 012 565.7 dated Sep. 25, 2006 and translation.

Search Report from German Application No. 10 2006 012 484.7 dated Sep. 1, 2006 and translation.

British Search Report dated Feb. 12, 2007 based on British Application No. GB 0620170.1.

Search Report from German Application No. 10 2006 012 580.0 dated Sep. 7, 2006.

M.и . PABCKиЙ, K иПH» IE PA3Pи IX» и TE» ЬXПOЬKA, 1969.

United Kingdom Search Report dated Mar. 13, 2006, issued in GB 0519748.8.

German Search Report dated Nov. 17, 2006, for DE 10 2005 045472.0.

German Search Report dated Dec. 18, 2007, issued in Application No. 10 2007 016 340.3.

* cited by examiner

APPARATUS ON A SPINNING ROOM MACHINE, ESPECIALLY A SPINNING PREPARATION MACHINE, FOR DEPOSITING FIBRE SLIVER

CROSS REFERENCE TO RELATED APPLICATION

This application claims priority from German Patent Application No. 10 2007 016 340.3 dated Apr. 3, 2007, the entire disclosure of which is incorporated herein by reference.

BACKGROUND OF THE INVENTION

The invention relates to an apparatus on a spinning room machine, especially a spinning preparation machine, for example, a flat card, draw frame, combing machine, integrated drawing system, roller card or the like, for depositing fibre sliver.

In certain known arrangements for depositing fibre sliver, a stationary delivery device (coiling plate) for delivering fibre sliver and a substantially flat receiving supporting surface for receiving and collecting the fibre sliver as a can-less fibre sliver package are present and the receiving supporting surface is substantially unenclosed. The receiving supporting surface is movable during the depositing process back and forth in the horizontal direction by a drive arrangement, and an alteration of the traversing speed is effected on a reversal path.

Such an apparatus is known from DE 102 05 061A.

SUMMARY OF THE INVENTION

It is an aim of the invention to provide an improved apparatus that enables production of the fibre sliver package to be substantially improved.

The invention provides an apparatus on a spinning room machine for depositing fibre sliver, having:

a sliver delivery device;

a substantially flat receiving support surface for receiving and collecting fibre sliver delivered by the delivery device, the support surface being substantially unenclosed; and a drive arrangement for driving the support surface back and forth between first and second reversal points during sliver deposition;

wherein the path along which the support surface is driven comprises opposed first and second reversal paths separated from one another by a further, traversing path portion along which the support surface is arranged to travel at a traversing speed, and on reaching an end of a traversing path portion and entering a reversal path the speed of the support surface is alterable such that a gradual braking to the speed value zero and a gradual acceleration from the value zero to the traversing speed are effected.

The receiving supporting surface is moved in the direction of the end faces along a traversing path and moved back along the same. This process is repeated periodically during sliver deposition. According to the invention, during the movement sequence along the traversing path the receiving supporting surface contains different movement moments in the vicinity of the reversal points. The traversing path is the distance between two reversal points. Starting from the reversal point, this traversing path is intentionally divided into an acceleration section, which merges into a section that is distinguished by a substantially uniform movement. This is followed by a braking section. The opposite reversal point is reached. The reversal of the traversing path is followed by an acceleration section. This is followed by a section on which analogously a substantially uniform movement is achieved. A braking section completes the sequence. Braking and acceleration sections are characteristic of each reversal point. Braking and acceleration sections are therefore referred to as the reversal path. It is a particular advantage that the substantially uniform traversing speed in the vicinity of the reversal points, i.e. in the region of the reversal paths, is altered gradually in accordance with the invention. The delivery and traversing speeds can thereby be increased. In particular, abrupt braking and acceleration processes are avoided. The can-less fibre sliver package is stably positioned during the back and forth movements and in particular on the reversal paths.

In some preferred embodiments, the speed of the receiving supporting surface on the reversal path is continuously alterable. In other embodiments, the speed of the receiving supporting surface on the reversal path is finely alterable (in fine steps). Advantageously, the alteration of the speed of the receiving supporting surface is effected in a path region that extends from the reversal point in the longitudinal direction of the movement of the receiving support surface approximately to a deposition radius of a sliver coil. That may allow the amount of sliver deposited in end regions of the fibre sliver package to be increased, if the speed of delivery of the sliver remains unchanged. Such a more uniform distribution of the sliver to the end regions as well as intervening regions can help to increase the stability of the fibre sliver package.

In one embodiment, the traversing speed of the receiving supporting surface is arranged to be reduced in the vicinity of the reversal point such that the speed of the receiving supporting surface approaching the reversal point is reducible corresponding to a falling, sinusoidal or cosinusoidal progression to the value zero at the reversal point and after traversing the reversal point is increasable corresponding to a sinusoidal or cosinusoidal progression up to the original traversing speed. Advantageously, the point in time for the start of the sinusoidal or cosinusoidal alteration of the traversing speed and the ending thereof is determinable in dependence on the delivery speed of the fibre sliver.

It is preferred that, in conjunction with a displacement device for the receiving support surface, a drive means is provided, which permits a back and forth movement of the displacement device in the longitudinal direction. Advantageously, means which inpart an altered speed to the receiving supporting surface in the region of the reversal points are provided. Advantageously, a single-motor drive means that is separate from the main drive of a draw frame or card is provided for the displacement device. Advantageously, the drive means for the displacement device comprises a servomotor, so that by changing the direction of rotation of the servomotor the direction of movement of the running gear is alterable. Advantageously, the servomotor is controllable by a computer as the control means. In certain embodiments, the movement of the receiving supporting surface into or out of the reversal path, in the vicinity of the reversal point, is detectable by a sensor. Preferably, the sensor is displaceable and fixable along the reversal path. The sensor may be, for example, a sensor that operates according to an optoelectronic or mechanical detection principle.

In certain preferred embodiments, by means of controllable drive means for the traversing device with receiving supporting surface for the fibre sliver package, the reversal path and/or the reversal time thereof is alterable independently of an alteration in the uniform transversing speed. Advantageously, the speed at which the can-less fibre sliver package is movable during the deposition process is dependent on the delivery speed of the spinning room machine, for example, a draw frame, and is directly electronically synchronised with this.

In accordance with the invention, it is advantageous that the can-less fibre sliver package is stably positioned during the back and forth movement, for example, the can-less fibre sliver package is stably positioned on the reversal path. The arrangement is advantageously such that the horizontal travel of the receiving support surface is adjustable. For example, the length of the sliver package may be adjustable over the horizontal travel. Advantageously, the horizontal travel and/or the length of the sliver package is pre-determinable by the drive control of the receiving support surface.

It is preferred that, in respect of the fibre sliver package, the displacement in the machine is effected without cans, containers or the like.

Preferably, the receiving support surface is of elongate construction. Advantageously, the deposited fibre sliver (can-less fibre sliver package) is movable by mechanical means.

It is preferred that the delivery device is a rotating rotary plate, or that the fibre sliver is depositable in coiled form by other means.

Advantageously, the can-less sliver package is movable horizontally back and forth on, and together with, the receiving support surface. Advantageously, the length of the receiving support surface corresponds to the maximum travel in the longitudinal direction beneath the rotary plate. Advantageously, the receiving support surface displaces the deposited fibre sliver (sliver package) back and forth on the deposition path. Advantageously, to assist the deposition process, fixing elements or the like may be provided on the surface of the receiving support surface. It is preferred that the deposited fibre sliver (sliver package) is displaceable in a jolt-free or virtually jolt-free manner in the depositing area. Advantageously, the alteration of the speed of the displacement device on the acceleration and braking path is effected substantially continuously (steplessly). Advantageously, a controllable drive device, for example, a drive motor, is associated with the displacement device. Preferably, the controllable drive device is connected to an electronic control and regulating device. Advantageously, the driven displacement device is capable of effecting a stable displacement of the deposited fibre sliver (sliver package).

Advantageously, the fibre sliver is freely deposited in the depositing region. Advantageously, the fibre sliver is displaceable in freely deposited form. It is preferred that the fibre sliver package is can-less.

Advantageously, the fibre sliver package is elongate, for example, substantially rectangular, in cross-section. It is preferred that the fibre sliver package is not laterally supported, such lateral support being unnecessary where, as achievable in accordance with the invention, the fibre sliver package is stable.

In certain preferred arrangements, during sliver deposit there is no gap between the top side of the fibre sliver package and the lower covering surface of the delivery device (coiler) and/or there is no gap between the top side of the fibre sliver package and the lower covering surface of the stationary coiler plate. Advantageously, the fibre sliver package presses with its top side against the lower covering surface of the coiler and/or the coiler plate and with its underside against the receiving support surface. Advantageously, the lowerable receiving supporting surface exerts a biasing force on the fibre sliver package.

Advantageously, a controllable drive device is present for the horizontal back and forth displacement of the receiving support surface. Preferably, the controllable drive devices for the horizontal displacement of the receiving supporting surface are connected to an electrical control and regulating device. Advantageously, the drive device for the delivery device (rotary plate) runs in slow gear during depositing of the first fibre sliver coils on the receiving supporting surface. Advantageously, the drive device, for example, drive motor, for the delivery device is connected to the control and regulating device. Advantageously, the receiving support surface is a support plate or the like. Advantageously, the receiving support surface is a support sheet (delivery table) or the like. Advantageously, the receiving support surface is connected to a quick-acting displacement device. The drive device may be a reversing motor, for example, servomotor. Advantageously, a speed-controlled electric motor, which is connected to a control device for setting pre-determined motor rotation speeds, is used as a drive device. The electric motor may be a frequency-controlled AC servomotor. It is preferred that the electric motor be constantly acceleratable and decelerateable over wide ranges. Advantageously, the electric motor can run at a constant speed between acceleration and deceleration. Advantageously, the length of the displacement path of the displacement device and the receiving support surface respectively is alterable. In practice, the rotary movement of the motor can advantageously be converted into a back and forth movement of the displacement device. In certain embodiments, there is used a drive motor that rotates continuously in one direction. Advantageously, the rotary speed of the electric motor is steplessly adjustable. Advantageously, before reaching the end point the speed is accelerated corresponding to a function. Advantageously, before reaching the end point the speed is decelerated corresponding to a function. Functions for use for those purposes can advantageously be stored, for example, in a suitable control device.

Advantageously, the speed at which the receiving supporting surface with the can-less fibre sliver package is moved during the deposition process is directly electronically synchronised with the delivery speed of the spinning room machine.

The invention further provides an apparatus on a spinning room machine, especially a spinning preparation machine, for example, a flat card, draw frame, combing machine, integrated drawing system, roller card or the like, for depositing fibre sliver, in which a stationary delivery device (coiling plate) for delivering fibre sliver and a substantially flat receiving supporting surface for receiving and collecting the fibre sliver as a can-less fibre sliver package are present and the receiving supporting surface is substantially unenclosed, in which the receiving supporting surface is movable back and forth in the horizontal direction during the depositing process by a drive arrangement, wherein an alteration of the traversing speed is effected on a reversal path, wherein the speed of the receiving supporting surface with the can-less fibre sliver package is alterable substantially on the reversal path such that a gradual braking to the speed value zero and a gradual acceleration from the value zero to the speed of the back and forth movement are effected.

Moreover, the invention provides a method for depositing fibre sliver, comprising delivering the fibre sliver through a rotating member to form coils that are received on a receiving support surface arranged beneath the rotating member, wherein the receiving support surface travels in reciprocatory manner between two reversal points with the support surface being subjected to a braking action as it approaches each reversal point and an acceleration action as it leaves each reversal point.

DETAILED DESCRIPTION OF CERTAIN PREFERRED EMBODIMENTS

Figure 1A:
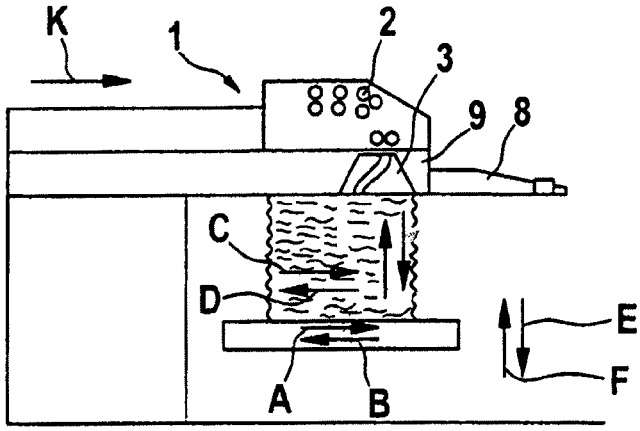
FIG. 1*a* is a diagrammatic side view of a draw frame having an apparatus according to the invention, using a support plate for depositing fibre sliver in the form of a can-less fibre sliver package, in one end position beneath the rotary plate.
Figure 1B:
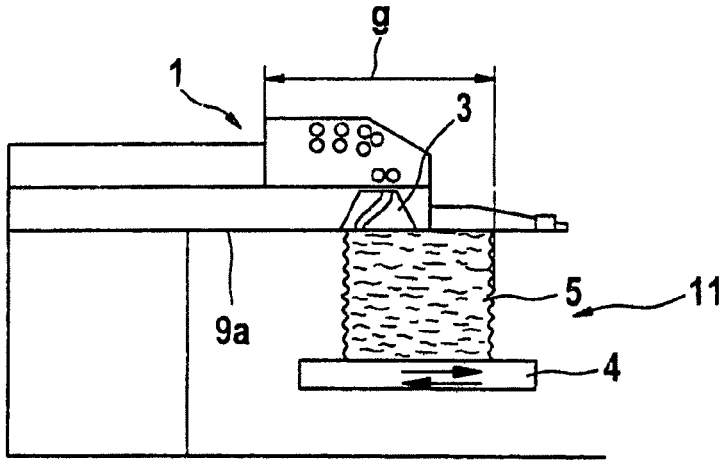
FIG. 1*b* shows the apparatus according to FIG. 1*a*, but in the other end position beneath the rotary plate.

FIGS. 1*a* and 1*b* show a draw frame 1, for example, a draw frame TD 03, made by Trützschler GmbH & Co. K.G. of Mönchengladbach, Germany. A plurality of fibre slivers, coming from an upstream lattice (feed table), enter a drafting system 2, are drafted therein and, after leaving the drafting system 2, are combined to form a fibre sliver 12. The fibre sliver 12 passes through a rotary plate 3 and is then deposited in coils on a base, which moves back and forth in the direction of arrows A and B, for example a support plate 4 having a rectangular top face $\mathbf{4}_1$, to form a can-less fibre sliver package 5. The support plate 4 is driven by a controllable drive motor 6, which is connected to an electronic control and regulation device 7, for example a machine controller (see FIG. 4). Reference numeral 8 denotes a cover plate of the sliver delivery device, which adjoins the rotary plate panel 9. K denotes the working direction (flow of fibre material) inside the draw frame 1, while the fibre sliver is delivered by the rotary plate 3 substantially in the vertical direction. Reference numeral 10 denotes the depositing area, reference numeral 11 denotes the region outside the depositing area 10. The depositing area 10 for the fibre sliver 12 comprises the path g in accordance with FIG. 1*b*. The support plate 4 is moved horizontally back and forth beneath the rotary plate 3 while the fibre sliver 12 is being deposited. FIG. 1*a* shows one end position and FIG. 1*b* shows the other end position of the support plate 4, which moves back and forth horizontally in direction A, B beneath the rotary plate 3 during deposition of the fibre sliver 12. The fibre sliver package 5 is moved back and forth corresponding to A, B—in the direction of arrows C, D beneath the rotary plate 3. Once the end position shown in FIG. 1*a* has been reached, the support plate 4 travels in the direction of arrow A, the support plate 4 being accelerated, driven at a constant speed and then braked. Once the end position shown in FIG. 1*b* has been reached, the support plate 4 travels back in the direction of arrow B, the support plate 4 being accelerated, driven at a constant speed and then braked. Switching-over between the back and forth movements is effected by the control device 7 in conjunction with the drive motor 6 (see FIG. 4). Once the desired amount of sliver has been deposited, the support plate 4 with the collected sliver is moved out of the depositing area to the position shown in FIG. 2.

The variable-speed electric motor 6 drives the support plate 4 at a jolt-free or almost jolt-free speed. In particular, the acceleration and the braking are jolt-free or almost jolt-free. The speed between acceleration and braking is constant. In this manner, the fibre sliver package 5 remains stable both during the back and forth movement in the depositing area 10 according to FIGS. 1*a* and 1*b* and during the movement out of the depositing area according to FIG. 2. The movements are so controlled that the production rate achieved is as high as possible, without the fibre sliver package 5 (sliver bundle) slipping or even toppling over.

Figure 4:
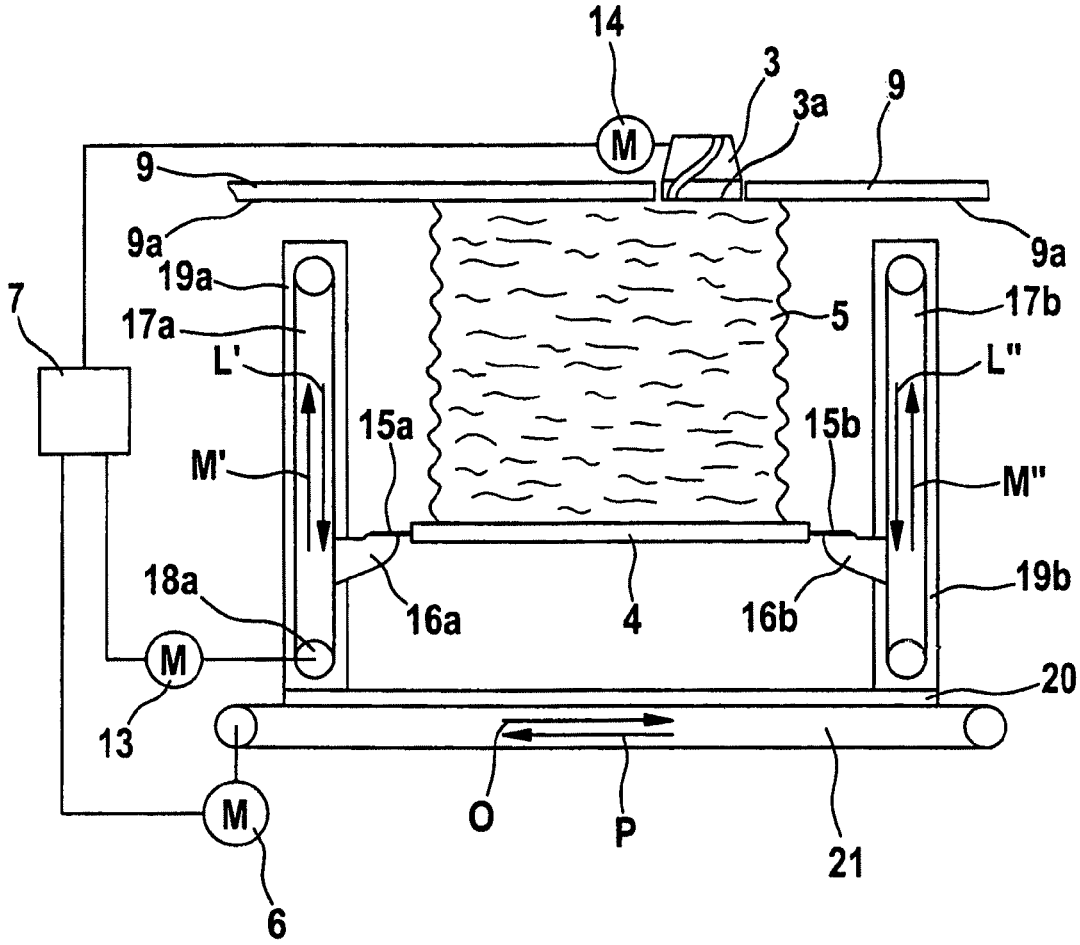
FIG. 4 shows a further embodiment of the apparatus according to the invention with a block diagram comprising an electronic control and regulation device, to which there are connected respective controllable drive motors for the horizontal displacement device of the support plate, for the vertical displacement device of the support plate and for the rotary plate.

While the fibre sliver 12 is being deposited, the control device 7 (which may be, for example, as shown in FIG. 4) controls the back and forth movement of the support plate 4 in order to produce a stable, can-less fibre sliver package 5. In accordance with one embodiment, the rotary plate 3 rotates in a fixed position and deposits the fibre sliver 12 on the support plate 4 at a substantially constant deposition pressure. The constant deposition pressure is achieved inter alia by deposition of the fibre sliver 12 at a constant delivery volume per fibre material layer of the fibre sliver 12. If, for example, the rotary plate 3 deposits fibre sliver 12 on the support plate 4 or on top of coils of fibre sliver already deposited, each layer of fibre sliver coils receives a substantially constant amount of fibre sliver 12 either during the forward movement or during the backward movement. The constant amount of fibre sliver 12 per layer enables stability of the fibre sliver package 5 to be achieved.

The amount by which the support plate 4 moves back and forth is also controlled by the increasing stability of the fibre sliver package 5. Whenever the support plate 4 reaches the reversal point of either the forward or backward movement, the control means 7 brakes the support plate 4, the support plate 4 reaching an edge region 402*a* or 402*b* of the fibre sliver package 5, and accelerates the support plate 4 when the support plate 4 leaves the edge region 402*a* or 402*b*. Between the edge regions 402*a* and 402*b* on each side of the fibre sliver package 5, the control means 7 controls the support plate 4 at a constant speed. The edge region 402*a* or 402*b* is the location at each end of the fibre sliver package 5 where the fibre sliver coils deposited on the support plate 4 do not completely overlap one another (see FIGS. 3*a*, 3*b*).

The edge region 402*a* or 402*b* is located shortly before the reversal point of the movement of the support plate 4 at each end of the fibre sliver package 5. In contrast, in the non-edge region 404, either during the forward or return movement of the support plate 4, the rearward edge of each fibre sliver coil is also arranged from above on the leading edge of the previously deposited fibre sliver coil.

With regard to the small proportion of fibre sliver that is deposited in the edge region 402*a* or 402*b*, the control device 7 brakes the support plate 4 so that more fibre sliver 12 can be deposited in the edge region 402*a* or 402*b* and accelerates the support plate 4 to a constant speed in the non-edge region 404. The braking of the support plate 4 leads to an increase in the proportion of fibre sliver deposited in the edge region 402*a* or 402*b*, because the rotary plate 3 deposits the fibre sliver 12 at a constant rate, irrespective of the movement of the support plate 4. Whenever the support plate 4 is braked, more fibre sliver 12 can be deposited at that point, which corresponds to the non-overlapping fibre sliver coils close to the reversal points. The non-uniform speed of the support plate 4 allows a substantially uniform amount of fibre sliver 12, which is deposited in both edge regions 402*a* and 402*b* and in the non-edge region 404 of the fibre sliver package 5 for each layer of fibre sliver 12 during the back and forth movement of the support plate 4. The non-uniform speed of the support plate 4 leads to a substantially uniform density of fibre sliver 12 at all points of the fibre sliver package 5. The uniform density of the fibre sliver 12 enables the fibre sliver package 5 to be formed stably on the support surface 5 and allows the fibre sliver package 5 to be accelerated and braked forwards and backwards, avoiding the possibility of the can-less, laterally unsupported fibre sliver package 5 becoming unstable or at risk of toppling over.

Figure 2:
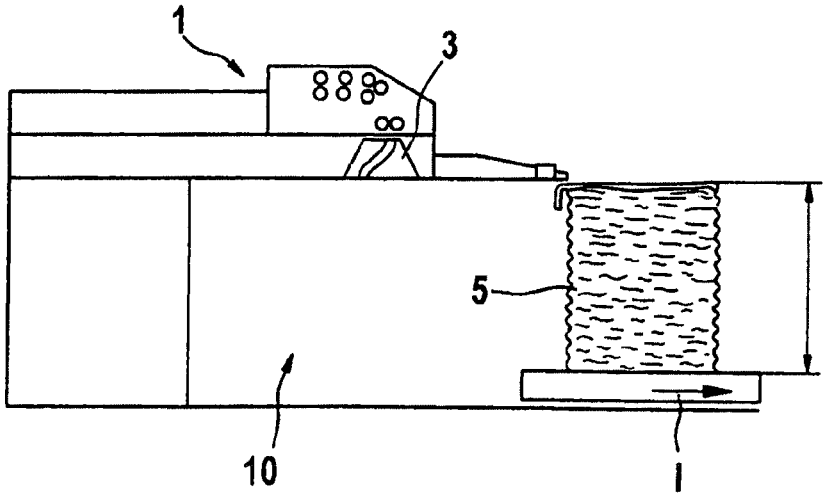
FIG. 2 shows the apparatus according to FIGS. 1*a*, 1*b*, but outside the sliver delivery device.

After the deposition of the fibre sliver package 5 on the surface 4 is complete, according to FIG. 2 the support plate 4, together with the fibre sliver package 5, moves out of the sliver delivery device in the direction of arrow I. The control means 7 controls the movement of the support plate 4 so that a changeover is made from the back and forth movement (arrows A and B) for the sliver deposition to the outward movement (arrow I) out of the depositing area 10 into the discharge region 11.

Figure 3A:
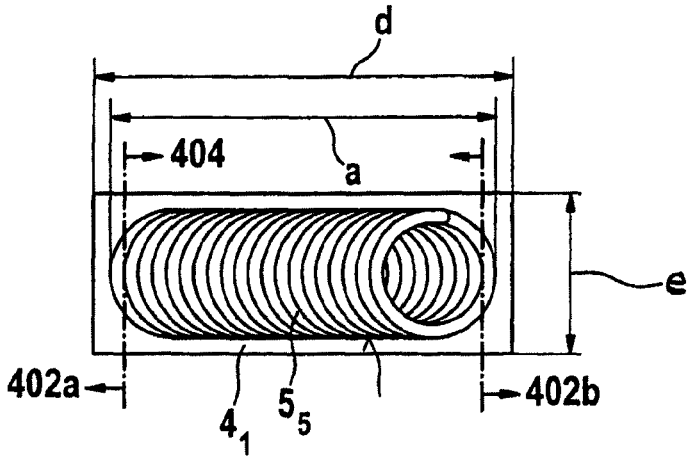
FIGS. 3*a*, 3*b*, 3*c* show a plan view (FIG. 3*a*), a side view (FIG. 3*b*) and a front view (FIG. 3*c*) of the can-less fibre sliver package deposited on the support plate.
Figure 3B:
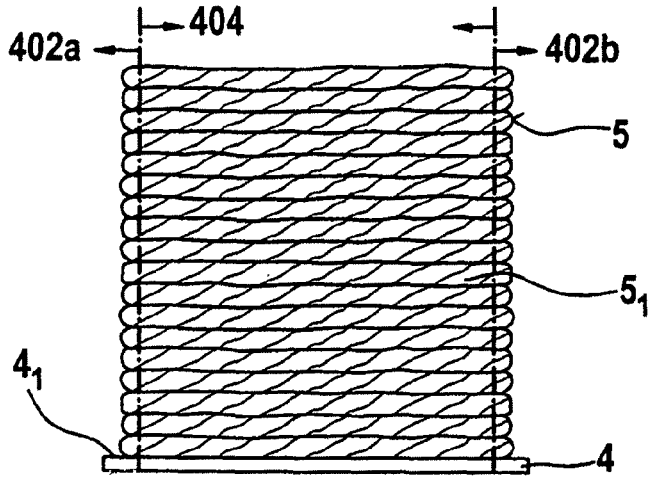
Figure 3C:
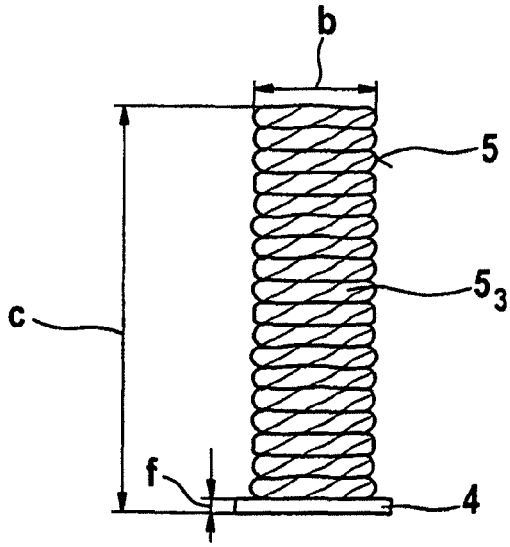

FIG. 3*a* shows a plan view of a ring-shaped fibre sliver package 5, which has been deposited freely on the top face $\mathbf{4}_1$ of the support plate 4. FIG. 3*b* shows a side view of the fibre sliver package 5, which is arranged freely on the support plate 4. FIG. 3*c* shows a front view of the fibre sliver package 5, which is positioned freely on the support plate 4. As shown in FIGS. 3*a* to 3*c*, the fibre sliver package 5 is formed from fibre sliver coils stacked in a substantially rectangular shape. The rectangular shape of the fibre sliver package 5 is created by the way in which the fibre sliver 12 has been deposited. The rotation of the rotary plate 3, by which the fibre sliver 12 is delivered, forms a layer of overlapping coils of fibre sliver 12 on a receiving surface 4*a* of the support plate 4, and the back and forth movement of the support plate 4 under the control of the control device 7 establishes the locations at which the fibre sliver coils are formed on the receiving surface $\mathbf{4}_1$. The movement of the support plate 4 has the effect that the deposited fibre sliver coils are arranged on the receiving surface $\mathbf{4}_1$ of the support plate 4 offset relative to one another and partly overlapping one another, which creates the substantially rectangular shape of the fibre sliver package 5—seen in plan view. At each end of the fibre sliver package 5—caused by the change in the direction of the back and forth movement of the support plate 4—the fibre sliver package 5 has rounded ends on the rectangular shape, as FIG. 3*a* clearly shows. The rectangular shape of the fibre sliver package 5 is advantageous, because—compared with conically or cylindrically shaped fibre sliver packages—it promotes the stability of the fibre sliver package 5.

FIG. 3*a* shows a plan view of the fibre sliver 12 of the fibre sliver package 5 deposited in coil form. FIGS. 3*b* and 3*c* show in side view and front view, respectively, the fibre sliver package 5 standing freely, that is to say without a can, container or the like, on the upper face $\mathbf{4}_1$ of the support plate 4. In respect of the dimensions of the fibre sliver package 5, the length according to FIG. 3*a* is denoted by reference letter a, the width according to FIG. 3*c* by reference letter b and the height according to FIG. 3*c* by reference letter c. With regard to the dimensions of the support plate 4, the length according to FIG. 3*a* is denoted by letter d, the width according to FIG. 3*a* by letter e and the height according to FIG. 3*c* by letter f. Reference numeral $\mathbf{5}_5$ (FIG. 3*a*) denotes the upper face, reference numeral $\mathbf{5}_1$ (FIG. 3*b*) a long side face and reference numeral $\mathbf{5}_3$ (FIG. 3*c*) a short end face of the substantially cuboidal fibre sliver package 5, which is of substantially rectangular cross-section. The other long side face, the other short end face and the base surface are not shown.

In the embodiment of FIG. 4, an electronic control and regulation device 7, for example a machine controller, is present, to which a controllable drive motor 6 for the horizontal displacement of the support plate 4, a controllable drive motor 13 for the vertical displacement of the support plate 4 and a controllable drive motor 14 for the rotary plate 3 are connected. A raising and lowering device is mounted on a carriage 20, and consists of a framework, guide rollers and a flexible transport element, which can be moved in the direction of arrows L', M', L", and M". The vertically displaceable (see arrows E, F in FIG. 1*a*) support plate 4 is provided with two driver elements 15*a*, 15*b*. These driver elements 15*a*, 15*b*, which are arranged on the opposite narrow sides of the support plate 4, rest on support elements 16*a*, 16*b*, which are secured to perpendicularly arranged flexible transport elements, for example toothed belts 17*a*, 17*b*, circulating around toothed belt wheels. One of the guide rollers 18*a* is driven by a motor 13. The motor 13 is in the form of a reversing motor, which can run at different speeds and in both directions of rotation. On arrival of an empty support plate 4, the driver elements 15*a*, 15*b* lie on the support elements 16*a*, 16*b* located at the bottom, so that upward displacement of the support elements 16*a*, 16*b* brings about an upward movement of the driver elements 15*a*, 15*b* and accordingly of the support plate 4. The transport elements 16*a*, 16*b* are secured, by means of holding elements 19*a*, 19*b* of the framework, to the carriage 20, which is moved horizontally back and forth in the direction of arrows O and P by a circulating conveyor element 21, for example a toothed belt circulating around toothed belt wheels.

The rotary plate 3 held by the fixed rotary plate panel 9 deposits fibre sliver 12 on the support plate 4, the fibre sliver package 5 thus formed standing on the support plate 4 and being moved back and forth in the direction of arrows A and B (see FIG. 1*a*). During the continuous fibre sliver deposition, the upper fibre sliver coils of the fibre sliver package 5 are constantly in contact with the underside 9*a* of the rotary plate panel 9. The deposited fibre sliver 12 of the fibre sliver package 5 presses against the underside 9*a* and against the lower cover face 3*a* of the rotary plate 3. So that a constant compressive force determined in advance is exerted vertically on the deposited fibre sliver 12, the control and regulating device 7 regulates the speed of the motor 13 so that the force exerted by the uppermost layer of the fibre sliver 12 remains constant. In other words, the speed of the motor 13 is such that the rate (amount) of downward movement of the support elements 16*a*, 16*b*, which are attached to the flexible transport elements 17*a*, 17*b*, in conjunction with the speed of fibre sliver deposition by the rotary plate 3 driven by the motor 14, ensures a uniform compression of the fibre sliver 12 in each height position of the downwardly moving support plate 4. After each traverse g (see FIG. 1*b*) in the horizontal direction, the support plate 4 is displaced downwards by a pre-set amount. As a consequence of the inherent resiliency of the fibre sliver 12 and as a consequence of the pressing force of the displaceable support plate 4, the can-less fibre sliver package 5 is pressed against the lower faces 9*a* and 3*a* of the rotary plate panel 9 and the rotary plate 3 respectively during the horizontal back and forth movement. The fibre sliver package 5 is accordingly stabilised both positively and non-positively during the horizontal back and forth movement.

FIG. 4 shows the carriage 20 with the holding device 19*a*, 19*b*, for example framework 19. The holding elements 19*a*, 19*b* hold two conveyor belts 17*a*, 17*b*, which are able to move the support plate 4 upwards or downwards in the direction of arrows L and M. The can-less fibre sliver package 5 is arranged on the top face $\mathbf{4}_1$ of the support plate 4. During fibre sliver deposition, the support plate 4 is moved back and forth in the direction of arrows O & P (corresponding to arrows A and B of FIG. 1). Once each corresponding end position (see FIGS. 1*a*, 1*b*) has been reached, the support plate 4 is displaced downwards in direction E always by less than the thickness of a fibre sliver, for example 10 mm, with the aid of the drive motor 13, in order to create a substantially constant space (or room) for the next layer of fibre sliver material to be deposited. The substantially constant room relates to the region between the upper side of the laterally unsupported fibre sliver package 5 and the base surface 3*a* of the rotary plate 3 and produces a constant filling force per deposited fibre sliver layer. The substantially constant space allows only room for fibre sliver 12 deposited for each fibre sliver layer, that room being substantially constant. A fibre sliver layer represents the amount of fibre sliver 12 that is deposited between an individual pair of movement reversal points for the support plate 4 (that is to say from the point at which the movement of the support plate 4 changes direction as far as the next reversal point). Deposition of the fibre sliver 12 into the substantially constant space allows a substantially constant density of fibre sliver 12 at all locations within the fibre sliver package 5, which promotes the stability of the fibre sliver package 5.

The substantially constant space formed by lowering (arrow E in FIG. 1) the support plate 4 is filled directly and immediately by the fibre sliver 12 constantly flowing in from the rotary plate 3. During sliver deposition, the upper side of the fibre sliver package 5 presses, with no spacing, against the base surface 3*a* of the rotary plate 3 and against the base surface 9*a* of the rotary plate panels 9. There is constant contact. The deposited fibre sliver mass of the fibre sliver package 5 is pressed against the lower faces 3*a* and 9*a* as a consequence of the inherent resiliency of the fibre sliver 12 and as a consequence of the biasing force of the displaceable support plate 4. At the same time, this results in a pre-compaction of the fibre sliver package 5, which is advantageous for further discharge and further transport of the fibre sliver package 5.

Figure 5:
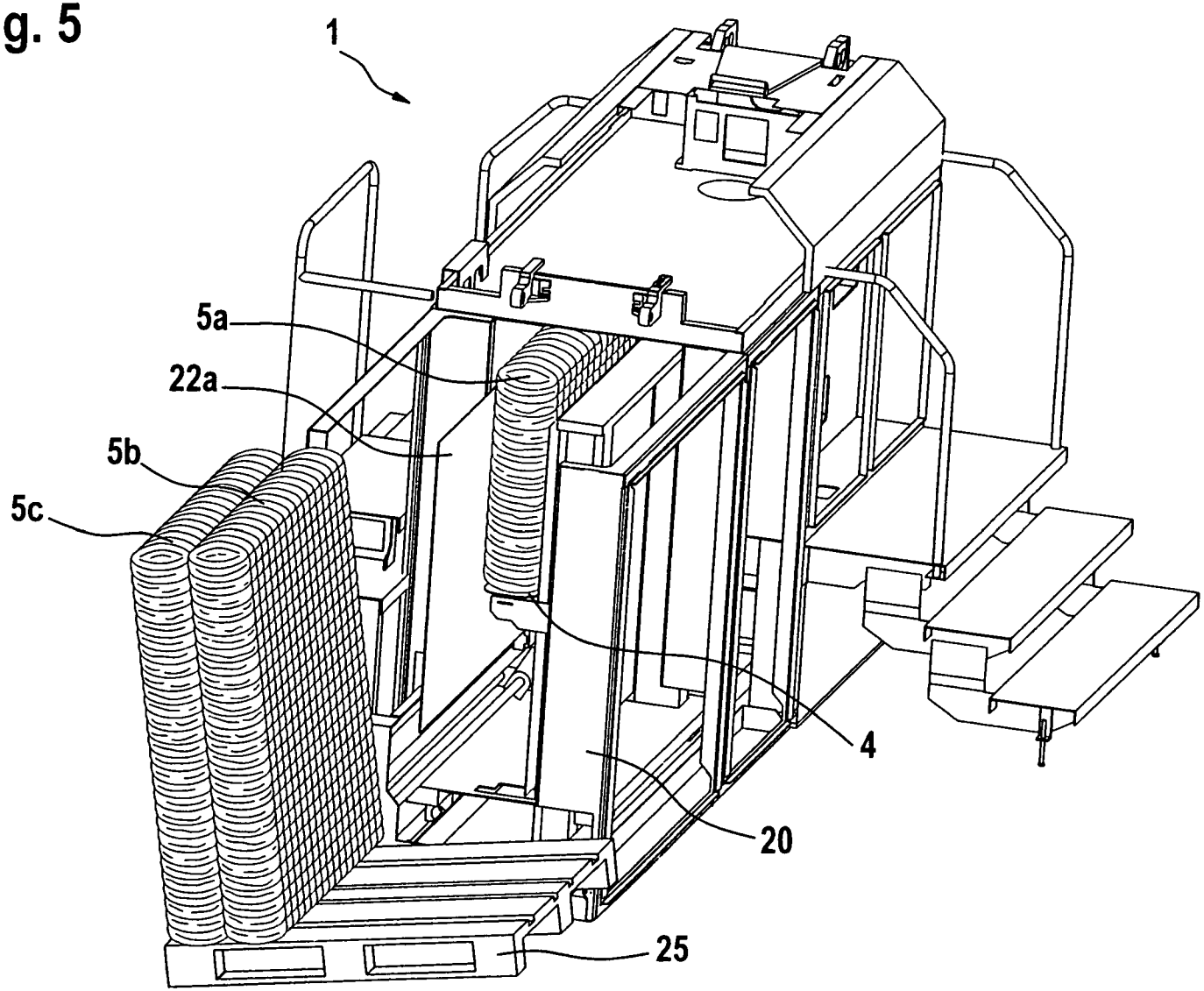
FIG. 5 is a perspective view of the outlet region of a draw frame having an apparatus according to a third embodiment of the invention, with a support plate and a can-less fibre sliver package in the sliver depositing area.

In the embodiment of FIG. 5, a fibre sliver package 5*a* is carried on a support plate 4 during sliver deposition in the depositing area 10. Reference numeral 20 denotes the carriage (guide device, holding device), which is movable back and forth horizontally. The fibre sliver package 5*a* is displaced horizontally in directions C and D of its longitudinal axis, that is to say in the direction of its long side faces.

Parallel to and spaced apart from a side face $\mathbf{5}_1$, there is a fixed side wall 22*a*, which is independent of the carriage and prevents any falling fibre material or the like from entering the machine. The length of the path g (see FIG. 1*b*) (traversing pass) is variable by means of the motor 6 (see FIG. 4), whereby the length a (see FIG. 3*b*) of the fibre sliver package 5*a* is adjustable. Downstream of the depositing area 10 there is arranged the discharge region 11, in which a transport pallet 25 is located on which the two fibre sliver packages 5*b*, 5*c* are stored side by side.

Figure 6:
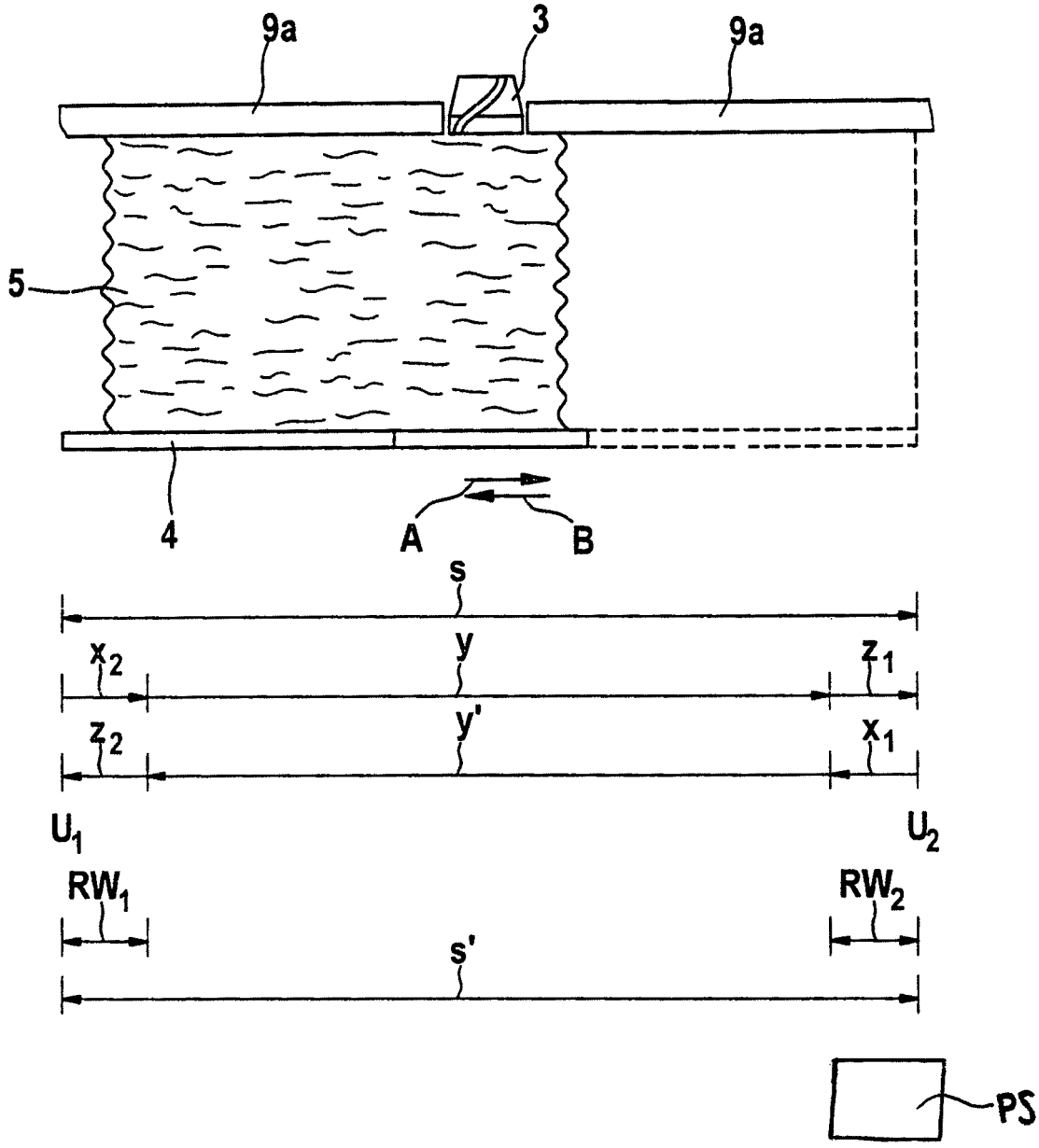
FIG. 6 shows diagrammatically certain definitions relating to the traversing path.

FIG. 6 shows the receiving supporting surface 4 with the can-less fibre sliver package 5 in an end position. The opposite end position of the receiving surface 4 with the can-less fibre sliver package 5 is represented by a broken line so that the receiving surface 4 is in the position of 4'. The receiving supporting surface 4 with the can-less fibre sliver package 5 is moved between the two end positions along a path s and back along the same path s'. Each of these paths s or s' is the traversing path. The traversing path is the distance between the two reversal points $U_1$ and $U_2$. A back and forth movement is effected when the receiving supporting surface 4 with the can-less fibre sliver package is moved on the traversing path s or s'. This process is periodically repeated during sliver deposition. Once the forward movement from reversal point $U_1$ to reversal point $U_2$ has been determined, then the return movement is correspondingly from reversal point $U_2$ to reversal point $U_1$. In this movement sequence, the receiving surface 4 with the can-less fibre sliver package 5 receives different movement moments. The traversing path s is in this respect subdivided into an acceleration path $x_2$, which merges into a path y characterised by a substantially uniform movement. Following this is a braking path $z_1$. At the reversal point $U_2$ the situation changes. An acceleration path $x_1$ follows, followed by the path y' which, analogously to the path y, is characterised by a substantially uniform movement. To finish, there is a braking path $z_2$. The braking and acceleration paths are characteristic of each reversal point $U_1$, $U_2$. The braking and acceleration paths are therefore referred to as the reversal path $RW_1$ and $RW_2$. Exceeding of the limit of the reversal paths $RW_1$ and $RW_2$ can be detected by a point sensor (PS). The reversal paths $RW_1$ and $RW_2$ may alternatively be programmed into the electronic control and regulating device 7 (see FIG. 4).

Deposition of sliver on the receiving supporting surface 4 by the rotary plate 3 is effected at a delivery speed of the draw frame, which can be set as constant, for example, 1000 m/min. An appropriate traversing speed is set proportional to this delivery speed. The traversing speed is achieved on the paths y and y' and is constant. This speed is gradually altered in a defined manner in the vicinity of the reversal points $U_1$ and $U_2$, that is to say in the region of the reversal paths $RW_1$ and $RW_2$.

An illustrative condition as applicable to constant reversal time at different traversing speeds is described below.

In that illustrative case, the continuous alteration of the constant traversing speed is so effected that the movement of the receiving supporting surface 4 with the can-less fibre sliver package 5 running towards the reversal point is reduced corresponding to the declining progression of a sine or cosine function. The reduction is effected down to the value zero at the reversal point. After passing through the reversal point the movement is increased again corresponding to a sinusoidal or cosinusoidal progression up to the maximum value, that is to say traversing speed. This procedure ensures that no abrupt braking and acceleration processes occur.

The continuous alteration begins on reaching the reversal path and ends on leaving the reversal path. The point in time for the change in the traversing speed in a sinusoidal or cosinusoidal progression is determined in dependence on the delivery speed of the fibre sliver. By changing this point in time, different length reversal paths are available for altering the traversing speed, in order to be able to hold the time (reversal time) for traversing the reversal path constant.

From the point of view that also the reversal path for different traversing speeds can be held constant or the acceleration for different traversing speeds can be held constant a region of the reversal path was defined, the maximum length of which corresponds approximately to the deposition radius of a sliver coil, where the continuous alteration of the traversing speed takes place under the different conditions.

Figure 7:
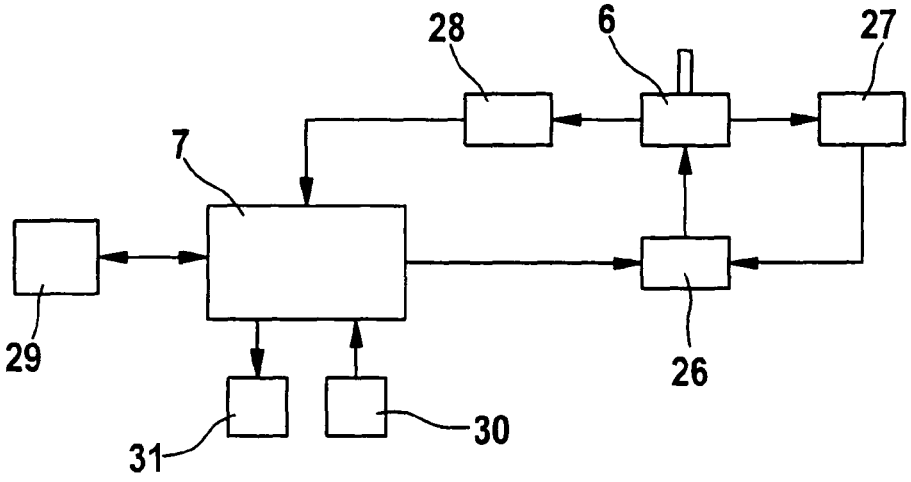
FIG. 7 shows a block diagram comprising an electronic control and regulation device with an apparatus according to the invention.

In the embodiment of FIG. 7, an electronic control and regulating device 7, for example, a microcomputer, is provided, and is connected via a motor control unit 26 to the electric motor 6. The electric motor 6, for example, a DC or AC servomotor, is connected via a rotational speed sensor 27 to the motor control unit 26. The drive motor 6 is connected via a displacement sensor 28, for example, an incremental displacement sensor, to the microcomputer 7, to which moreover a terminal 29, sensors 30 and actuators 31 as well as the measuring and actuating elements for the control and regulation of the draw frame are connected.

The displacement sensor 28 communicates to the microcomputer 7 at all times the particular location of the receiving supporting surface 4. The length of the path on which the receiving supporting surface 4 is moved during the deposition operation depends on the particular construction and is preset in the microcomputer 7 by program (reversal points, for example, $U_1$=zero and $U_2$=100). Provided that the receiving supporting surface 4 is not fully filled, it is moved back and forth continuously at a predetermined speed v between the two end points ($U_1$ and $U_2$) of the traversing path.

Figure 8A:
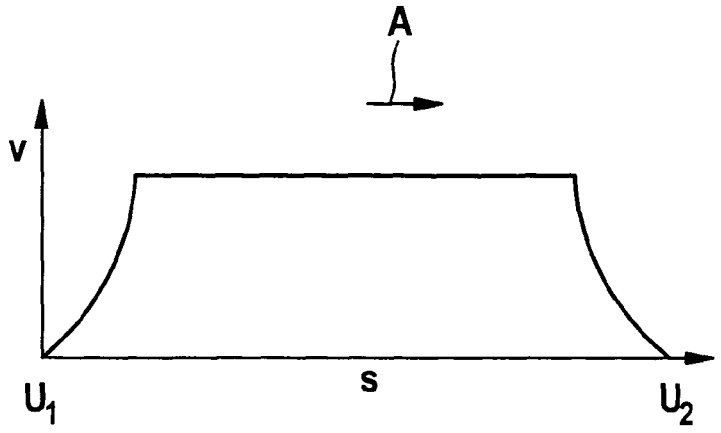
FIGS. 8*a*, 8*b* show the dependency of the movement speed of the receiving supporting surface with the can-less fibre sliver package on the depositing path.
Figure 8B:
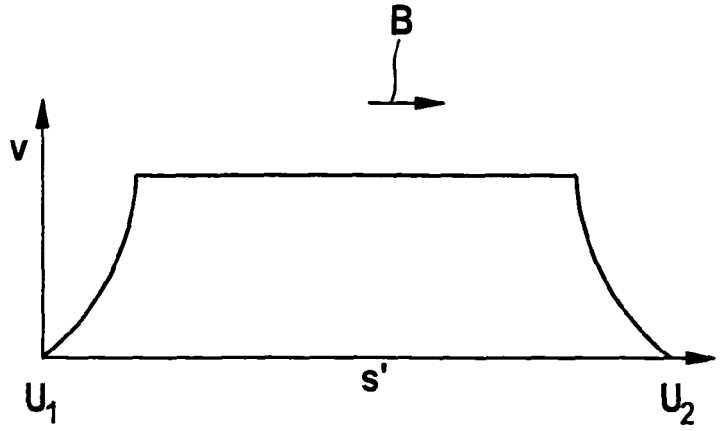

The speed v at which the receiving supporting surface 4 is moved back and forth between the end points ($U_1$ and $U_2$) of the traversing paths s, s' is variable and can be preset by the microcomputer 7 in the motor control unit 26 depending on requirement. In particular shortly before the end points are reached, braking can be carried out corresponding to a programmable function. When the end point is reached, the direction of movement is reversed and accelerated corresponding to a programmable function (compare for this purpose FIGS. 8*a*, 8*b*). For example, the electric motor 6 can be constantly accelerated or decelerated. It may also be expedient specifically to compensate for the overlapping of the sliver coils at the reversal points by the acceleration or deceleration. The speed v at which the receiving supporting surface 4 is moved during the filling procedure on the path s, s' is dependent on the delivery speed of the machine (draw frame) and directly (electronically) synchronised with this.

In spinning, cans, also called spinning cans, are hollow bodies (containers), which are used for the deposition, housing and removal of fibre slivers. The cans are forwarded, transported, stored and supplied. Such cans are in the form of rectangular cans enclosed on all sides by walls, that is to say having four side walls and a base wall, with the exception of the open upper side, which is used as a filling and removal opening for the fibre sliver. In contrast, the invention relates to can-less fibre sliver packages 5, that is to say no cans, containers or the like for the fibre sliver are present. The fibre sliver is deposited and conveyed in the form of a can-less fibre sliver package 5.

Although the foregoing invention has been described in detail by way of illustration and example for purposes of understanding, it will be obvious that changes and modifications may be practised within the scope of the appended claims.

What is claimed is:

1. An apparatus on a spinning room machine for depositing fibre sliver, comprising:

a sliver delivery device;

a substantially flat receiving support surface for receiving and collecting fibre sliver delivered by the delivery device, the receiving support surface being substantially unenclosed;

a drive arrangement for driving the receiving support surface back and forth between first and second reversal points during sliver deposition;

a path along which the receiving support surface is driven comprising opposed first and second reversal paths, the reversal paths being separated from one another by a further, traversing path portion, and a control device to control the receiving support surface at a traversing speed along the traversing path portion, the control device adapted to alter the speed of the receiving support surface at an end of the traversing path portion and at a beginning of the first or second reversal path, wherein the control device gradually brakes the receiving support surface from the traversing speed in a falling sinusoidal or cosinusodial progression to a speed value of zero at the first or second reversal point, and wherein the control device gradually accelerates the receiving support surface from zero in a sinusoidal or cosinusoidal progression to the traversing speed after the receiving support surface traverses the first or second reversal point.

2. The apparatus according to claim 1, wherein the speed of the receiving support surface on the reversal path is continuously alterable by the control device.

3. The apparatus according to claim 1, wherein the speed of the receiving support surface on the reversal path is finely alterable in stepwise fashion by the control device.

4. The apparatus according to claim 1, wherein the delivery device is a rotating rotary plate, the fibre sliver being depositable in coiled form.

5. The apparatus according to claim 4, wherein the control devices alters the speed of the receiving support surface in a path region that extends from the first or second reversal point in the longitudinal direction of the movement of the receiving support surface approximately to a deposition radius of a sliver coil.

6. The apparatus according to claim 1, wherein a point in time for a start of the sinusoidal or cosinusoidal alteration of the traversing speed and an ending thereof is determinable by the control device in dependence on a delivery speed of the fibre sliver.

7. The apparatus according to claim 1, wherein the drive arrangement further comprises a displacement device for the receiving supporting surface, a drive device for effecting a back and forth movement of the displacement device in the longitudinal direction and the control device.

8. The apparatus according to claim 7, wherein the drive device for the displacement device is a single-motor drive device that is separate from a main drive of the spinning room machine.

9. The apparatus according to claim 8, wherein the drive device is so controllable that the reversal path of the support surface and/or a reversal time thereof is alterable independently of an alteration in the traversing speed.

10. The apparatus according to claim 9, further comprising:

an electronic control and regulating device coupled to the drive device; and a delivery drive for the delivery device coupled to the electronic control and regulating device.

11. The apparatus according to claim 7, wherein the drive device comprises a speed-controlled electric motor, coupled to the control device, wherein the control devices sets predetermined motor rotation speeds.

12. The apparatus according to claim 11, wherein the speed-controlled electric motor rotates continuously in one direction and a rotary speed of the electric motor is steplessly adjustable.

13. The apparatus according to claim 1, further comprising at least one sensor, wherein movement of the receiving support surface into or out of the first or second reversal path in a vicinity of the first or second reversal point respectively is detectable by the at least one sensor.

14. The apparatus according to claim 1, wherein the drive arrangement is arranged such that the speed at which the support surface is movable during the deposition process depends on a delivery speed of the spinning room machine and the speed of the support surface is electronically synchronized with the delivery speed of the spinning room machine.

15. The apparatus according to claim 1, wherein the drive arrangement is arranged such that a can-less fibre sliver package formed from the fiber sliver deposition is stably positioned during the back and forth movement of the support surface and is stably positioned on the first or second reversal path without lateral support.

16. The apparatus according to claim 1, wherein the traversing path or a length of a sliver package formed from the fiber sliver deposition is adjustable and is pre-determinable by the control device of the receiving support surface.

17. The apparatus according to claim 1, wherein the receiving support surface is of elongate construction, wherein a length of the receiving support surface substantially corresponds to a maximum travel of the support surface in the longitudinal direction beneath the delivery device, and in use a substantially oblong can-less sliver package is formed which is movable horizontally back and forth on, and together with, the receiving support surface.

18. The apparatus according to claim 1, wherein the drive arrangement is such that the deposited fibre sliver is displaceable in a substantially jolt-free manner in the depositing area.

19. The apparatus according to claim 1, wherein the drive arrangement is such that there is no gap between a top side of a fibre sliver package formed from the fiber sliver deposition and a lower covering surface of the delivery device.

20. The apparatus according to claim 19, wherein the receiving support surface is lowerable by the control device and the support surface exerts a biasing force on the fibre sliver package such that the fibre sliver package presses with its top side against the lower covering surface of the delivery device and/or coiler plate.

21. The apparatus according to claim 1, wherein a drive device for the delivery device runs in slow gear during depositing of the first fibre sliver coils on the receiving supporting surface.

22. The apparatus according to claim 1, wherein the control device comprises an acceleration function and a deceleration function stored in the device, wherein the control device decelerates the support plate in the deceleration function before the support plate reaches the first or second reversal point and wherein the control device accelerates the speed of the support surface in the acceleration function after the support plate reaches the first or second reversal point.

* * * * *